United States Patent [19]

Vitale

[11] Patent Number: 5,022,229

[45] Date of Patent: Jun. 11, 1991

[54] STIRLING FREE PISTON CRYOCOOLERS

[75] Inventor: Nicholas G. Vitale, Albany, N.Y.

[73] Assignee: Mechanical Technology Incorporated, Latham, N.Y.

[21] Appl. No.: 484,216

[22] Filed: Feb. 23, 1990

[51] Int. Cl.[5] ..... F25B 9/00

[52] U.S. Cl. ..... 62/6; 60/517

[58] Field of Search ..... 62/6; 60/517, 520

[56] References Cited

U.S. PATENT DOCUMENTS

| | | | |
|---|---|---|---|
| 3,552,120 | 1/1971 | Beale | 62/6 |
| 4,387,567 | 6/1983 | White | 62/6 |
| 4,458,495 | 7/1984 | Beale | 62/6 |
| 4,642,988 | 2/1987 | Benson | 62/6 |
| 4,694,650 | 9/1987 | Vincent | 62/6 |
| 4,799,421 | 1/1989 | Bremer et al. | 60/517 |

*Primary Examiner*—Ronald C. Capossela

*Attorney, Agent, or Firm*—Joseph C. Sullivan; Joseph V. Claeys

[57] ABSTRACT

The present invention relates to a Stirling free piston cryocooler in which the drive assembly is arranged in an in-line opposed piston arrangement. The displacer piston assembly is nested within the power piston assembly. In one embodiment the thermodynamic assembly is connected to the drive mechanism in a tee arrangement so that the opposed cryocooler pistons share a common expansion space. In another embodiment the thermodynamic assembly is connected to the drive mechanism in a double split tee arrangement with the thermodynamic components remotely located from the expansion and compression spaces and connected thereto by flexible tubes.

13 Claims, 2 Drawing Sheets

STIRLING FREE PISTON CRYOCOOLERS

FIELD OF THE INVENTION

The present invention relates to the use of Stirling free piston cryocoolers that provide for high performance, long life, low cost and low vibration.

BACKGROUND OF THE INVENTION

The use of refrigeration apparatus for cooling at low temperatures is known. As discussed in U.S. Pat. No. 3,636,719, conventional refrigeration apparatus can take on a variety of configurations. In a displacer type unit, a basic design involves the use of a displacer positioned in a cylinder defining expansion and compression chambers. Coupled between these chambers is a regenerator type heat exchanger through which gas passes. In operation, the displacer on which a mechanical reciprocal movement is imparted, reciprocates between upper and lower dead points. At the lower dead point compressed gas is admitted into the compression chamber which is then compressed upon movement of the displacer. The gas then passes through the heat exchanger where the gas exchanges heat with it and into the expansion space where it undergoes adiabatic expansion which decreases its temperature and produces cold. When the displacer moves down, the gas in the expansion chamber is forced through the heat exchanger, giving it cold. The cycle then repeats itself continually producing cold.

While Stirling engines have been utilized in refrigerating applications (see *Stirling Engines* by G. Walker, Clarendon Press, 1980, Pages 446–450) and have operated satisfactorily, however they are extremely complicated and expensive to construct and have high vibrational levels. Accordingly, there exists a need for a refrigerator apparatus which operates on a Stirling engine cycle which is effective at very low temperatures, providing for good thermodynamic performance and which achieves low overall vibration levels, providing for hydrodynamic gas bearings for long life and has low cryocooler contamination.

It would further be desirable to design the invention so that it minimizes the size of components, and reduces manufacture and assembly costs.

SUMMARY OF THE INVENTION

It is therefor an object of the invention to provide high performance, low cost, low vibration, long life Stirling free piston cryocoolers.

It is yet another object to provide an invention for connecting the cryocooler thermodynamic assembly and the cryocooler drive system to accommodate thermal expansion effects while providing good thermodynamic performance.

It is a further object to provide a cryocooler displacer components nested within power piston components to reduce the size of the cryocooler's mechanical components.

It is still a further object of the invention to provide an invention wherein manufacturing is simplified and cost is reduced by limiting the use of close tolerance stepped bores.

In order to implement these and other objects of the invention, which will become more readily apparent as the invention proceeds the present invention provides in line opposed cryocoolers in which the mechanical drive system is formed of a power piston assembly and a displacer assembly.

BRIEF DESCRIPTION OF THE DRAWINGS

For a fuller understanding of the nature of the objects of the invention, reference should be held to the following detailed description, taken in connection with the accompanying drawings, in which.

DETAILED DESCRIPTION OF THE PREFERRED EMBODIMENTS

Figure 1:
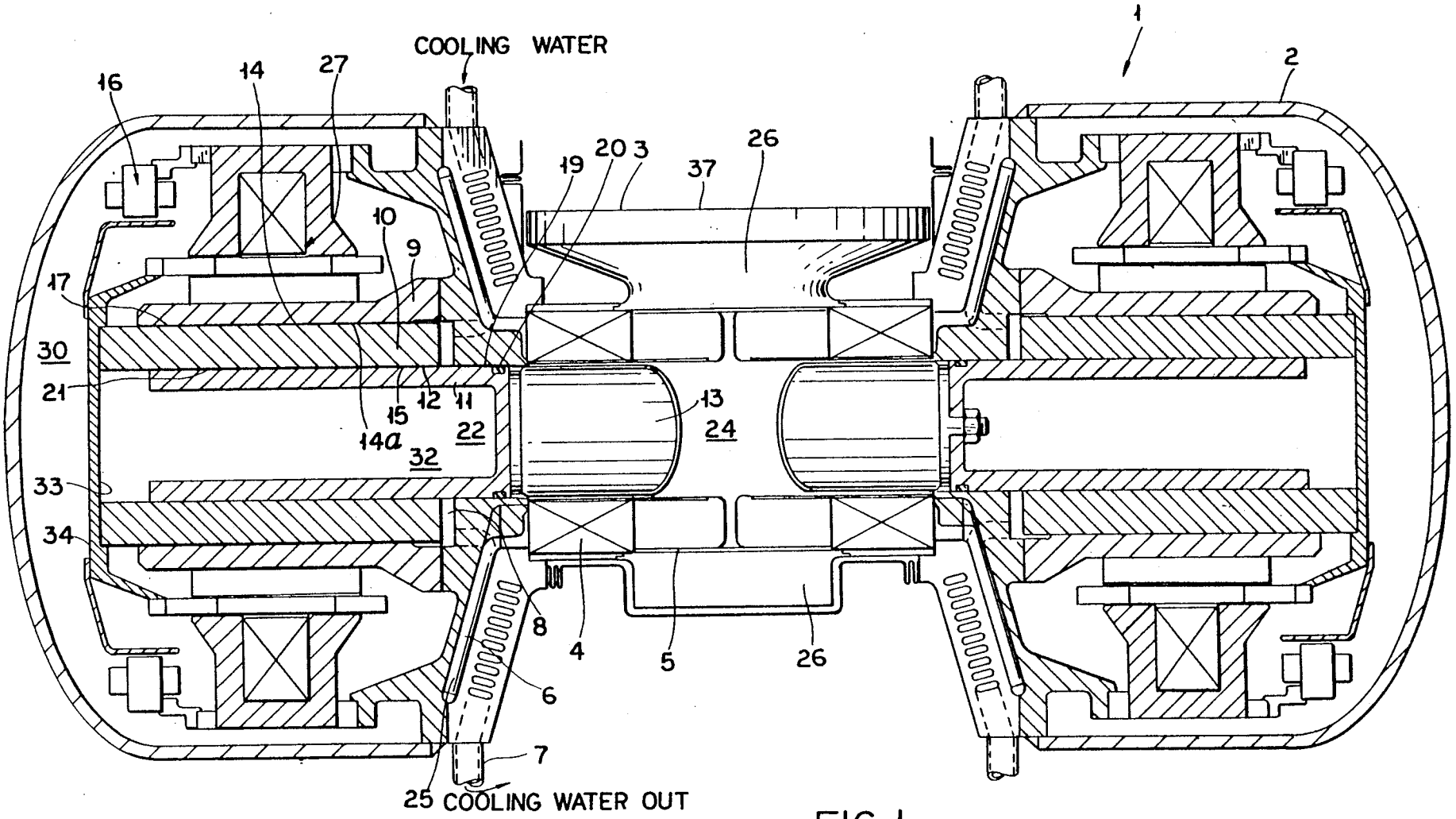
FIG. 1 is a sectional schematic view of a first embodiment of the present invention.

Referring now to the drawings, FIG. 1 discloses a first embodiment of the invention. The cryocooler 1 has a pressure vessel enclosure 2. Inside, the vessel 2 is an opposed cryocooler configuration with a thermodynamic assembly including a centrally integrated cold head 3, regenerator 4, the expansion space heat exchanger 5, the compression space heat exchanger 6, and cylindrical pipes 7 which provide cooling water for the compression space 8.

The mechanical drive of the invention includes a power piston cylinder 9, a power piston 10 and a displacer piston 11 having a displacer dome 13.

The power piston cylinder 9 has an inner bore 14 and 19 which is stepped with 14 being the larger bore and 19 being the smaller bore. The larger bore 14 of the power piston cylinder 9 forms the cylinder for power piston 10. The power piston 10 has a cylindrical shape with an outer diameter **14*a* and an inner bore 15, respectively. The outer diameter 14*a* of the power piston 10 is adapted to slide with a close clearance within the large bore 14 of the power piston cylinder 9. A spin motor 16 rotates the power piston 10 within the bore 14 of the power piston cylinder 9 thus providing the power piston 10 with a working gas hydrodynamic bearing 17. The close clearance between these surfaces provide the outer gas seal for the power piston 10. This seal serves to restrict gas flow between the compression space 8 and the bounce space 30**.

The displacer assembly is nested within the power piston assembly and includes the displacer piston 11 and the displacer dome 13. The displacer piston 11 is formed as a simple cylinder and is adapted to slide into the inner bore 15 of the power piston 10 within close clearance. The power piston inner bore 15 and the power piston cylinder smaller bore 19 are essentially of the same diameter and are concentric to each other so that the displacer piston 11 fits slidably within both bores simultaneously.

A dry lube displacer piston ring 20 is located between the displacer piston 11 and the inner bore 19 of power piston cylinder 9 to provide a compliant seal. The displacer piston ring 20 eliminates the need to have a very close tolerance between the large bore and the small bore of the power piston cylinder. In addition, the displacer piston ring 20 applies a rotational restraining force between the displacer piston 11 and the inner bore of power piston cylinder 9.

A second hydrodynamic gas bearing 21 is formed between the power piston 10 and the displacer piston 11 due to the relative rotation between the power piston inner bore 15 and the rotationally stationary displacer outer diameter 12. The close clearance between these surfaces provide the inner gas seal for the power piston 10. This seal serves to restrict gas flow between the compression space 8 and the gas spring 22.

A gas spring 22 is thermodynamically formed by the gas space 22 between the rear facing back face 32 of the displacer piston 1 and the forward face 33 of the plunger carrier 34 of a linear motor 27 of the power piston 10. Thus, the gas spring 22 is formed with the enclosed volume of these two faces as shown in FIG. 1. The gas spring 22 provides the necessary spring force for the displacer piston 11. The gas spring 22 also transfers mechanical power from the displacer piston 11 to the power piston 10 and thus provides a path for the mechanical power transferred from expansion space 24 to the dome 13 of displacer piston 11.

The cryocooler cold head assembly includes the cold head 3, the expansion heat exchanger 5 and the regenerator 4 arranged in a tee configuration as shown in FIG. 1.

The cryocooler has a common expansion space 24. The expansion space heat exchanger 5 is disposed between the expansion space 24 and the regenerator 4. The expansion heat exchanger 5 is cylindrical in shape so that the working gas passes over the finned inside of the cylinder. The external heat required during expansion is suppled externally to the outer surface of the expansion heat exchanger 5 and passes through the cylinder wall to the inside surface.

Expansion heat exchanger 5 may be conveniently formed within a central bore of a body 26 of high thermal conductivity material, such as copper, which serves to transfer the cooling to a working surface 37 of cold head 3, as shown in FIG. 1.

The spin motor 16 rotates the power piston 10. The linear drive motor 27 actuates the linear reciprocating motion of the drive assembly.

Figure 2:
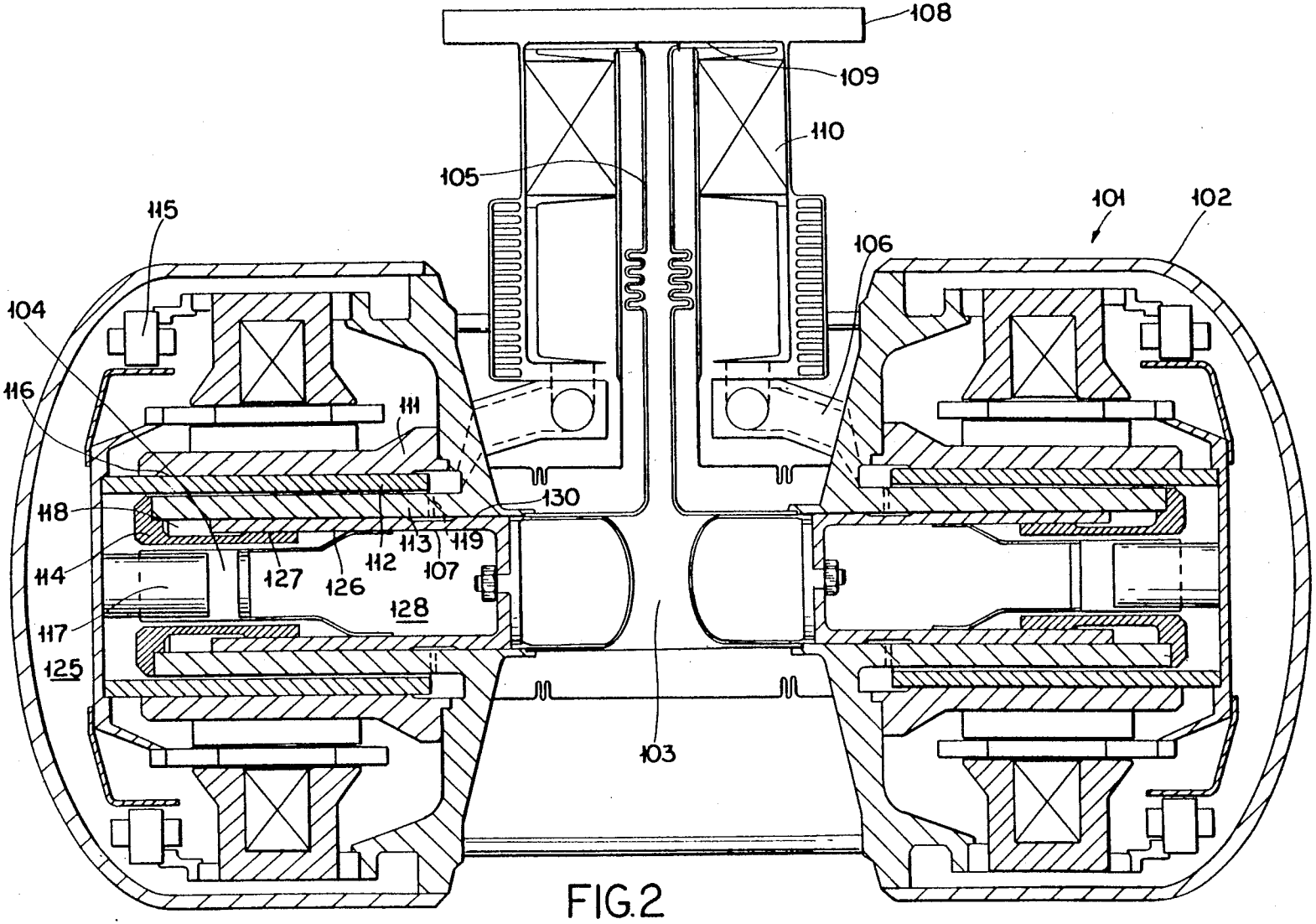
FIG. 2 is a sectional schematic view of a second embodiment of the present invention.

Referring now to FIG. 2, FIG. 2 shows a second embodiment of the present invention of a cryocooler 101 housed in a pressure vessel enclosure 102 in which the cryocooler thermodynamic assembly is connected to the drive mechanism in a double split tee arrangement. The thermodynamic components are located remote from the expansion space 103 and the compression space 104 and are connected thereto by flexible tubes 105, 106 for the expansion and compression spaces. Unlike a split cryocooler design, in the embodiment of FIG. 2 the displacer piston 107 is not part of the cold head 108 but is instead part of the main mechanical drive in an opposed piston arrangement.

As shown in FIG. 2, the cold head 108 is flat shaped and its back surface is formed by an expansion heat exchanger 109. The cold head 108 is mounted directly above the expansion face of the regenerator 110. The advantages of the arrangement are that it provides for excellent thermal communication between the cold head 108 and the expansion space heat exchanger 109 and excellent integration of the expansion heat exchanger 109 and the regenerator 110. The expansion space flexible tube 105 and the compression flexible tubes 106 attenuate vibration from the opposed cryocooler mechanical drive system.

The mechanical drive system of FIG. 2 includes a power cylinder 111, a power piston 112, a displacer cylinder 113, a displacer piston 107 and a displacer seal cylinder 114.

The power piston cylinder 111 and the power piston 112 are cylindrically shaped. The outer diameter of the power piston 112 fits slidably with close clearance within the inner bore of the power cylinder 111. The bearing spin motor 115 rotates the power piston 112 within the bore of the power piston cylinder 111 and provides the power piston working gas hydrodynamic bearing 116. The close clearance between these surfaces provides the power piston gas seal between the compression space 104 and the bounce volume 125.

The outer diameter of the displacer cylinder is located inside the inner bore of the power piston 112 and is separated by a relatively large clearance. The larger clearance provides a gas flow path between the forward face of the front of the power piston 112 and the forward face of the rear of the power piston 112, and consequently the total face area of the power piston is the sum of the area of both faces (i.e., the total projected face area of the power piston). The gas in the rear section of the power piston 112 is part of the compression space 104. The large clearance also eliminates the need for close manufacturing tolerances between the displacer cylinder outer diameter and the power piston inner bore.

The displacer cylinder 113 and the displacer piston 107 are cylindrically shaped. The outer diameter of the displacer piston 107 fits slidably with close clearance within the inner bore of the displacer cylinder 113. Rotation of the displacer piston 107 within the bore of the displacer cylinder 113 provides the displacer piston 107 working gas hydrodynamic bearing 126 and the close clearance between these surfaces provides the displacer piston gas seal. The displacer piston 107 is rotated by means of a sliding joint 117 between the displacer and power pistons.

The displacer piston seal defines a displacer rod. The seal is formed by a clearance seal 127 between the displacer piston inner bore and the displacer piston seal outer diameter. In order to maintain concentricities between these two elements, the displacer piston is piloted off the displacer cylinder inner bore, and the displacer piston inner bore is made concentric with the displacer piston outer journal. The rear face of the displacer piston between the outer journal and the inner bore is prevented from communicating with the cryocooler compression space 104 by the clearance seal and hence forms the displacer rod. This face also forms part of the displacer gas spring 118 (the volume for this gas spring is provided in the fore part of the inner volume 128 of the displacer piston and the volume is connected to the face by means of holes drilled within the displacer wall).

An annular groove 119 is machined into the outer diameter of the displacer piston 107. This groove 119 is vented to the compression space and serves to reduce the pressure drop across the displacer appendix gap seal 130. Low levels of appendix gap flow are required for good thermodynamic performance.

The key features of the mechanical drive system include rotation for both power piston and displacer bearings provided by a single spin motor; the displacer drive is reflexed within the power piston; only one close clearance concentric seal is required; and excellent displacer appendix gap sealing is provided without the use of a piston ring.

Obviously numerous modifications may be made to the present invention without departing from its scope as defined in the appended claims.

What is claimed:

1. A Stirling free piston cryocooler, comprising:

two opposed cyrocooler piston assemblies having a common expansion space therebetween, each said piston assembly including a power cylinder having a cylindrical shape, a large bore forming a cylinder and a small bore, a power piston having a cylindrical shape, an inner bore and an outer diameter, said outer diameter being adapted to slide with close clearance within said large bore of said power piston cylinder, and a displacer piston having a cylindrical shape and being adapted to slide into said inner bore of said power piston with close clearance;

a linear drive motor for actuating linear reciprocating motion of said piston assembly;

a bearing spin motor for rotating said power piston; and a thermodynamic assembly including a cold head adjacent said expansion space and at least one regenerator and at least one expansion space heat exchanger located between said expansion space and said at least one regenerator.

2. A Stirling free piston cryocooler according to claim 1, wherein said inner bore of said power piston and said smaller bore of said power piston cylinder are approximately the same diameter and concentric to each other so that said displacer piston is adapted to slide within both bores simultaneously.

3. A Stirling piston cryocooler according to claim 1, further comprising a dry lube displacer piston disposed between said displacer piston and the inner bore of said power piston to effect a compliant seal.

4. A Stirling free piston cryocooler according to claim 1, wherein said cold head is cylindrically shaped.

5. A Stirling free piston cryocooler according to claim 1, wherein said cold head is connected to the expansion heat exchangers of said cryocooler by a body of high thermal conductivity material.

6. A Stirling free piston cryocooler according to claim 5, wherein said body of high thermal conductivity material is a copper block.

7. A Stirling free piston cryocooler according to claim 1, comprising a compression space disposed rearwardly of said displacer piston wherein heat is removed from the compression space by at least one cylindrical pipe.

8. A Stirling free piston cryocooler according to claim 1, further comprising at least one compression heat exchanger.

9. A Stirling free piston cryocooler comprising: two opposed cryocooler piston assemblies having a common expansion space therebetween, each said piston assembly including:

a power cylinder having a cylindrical shape;

a power piston having a cylindrical shape, and an inner bore, and adapted to fit slidably within said power piston cylinder;

a displacer cylinder having a cylindrical shape and an inner bore, and an annular groove in an inner bore of said displacer cylinder venting into a compression space to reduce pressure drop across a displacer appendix gap seal, said displacer cylinder being adapted to fit slidably within said inner bore of said power cylinder separated by a large clearance defining a gas flow path therein;

a displacer piston, having a cylindrical shape and adapted to fit slidably with said inner bore of said displacer cylinder;

a displacer seal piston connecting the rear face of said displacer cylinder to the inner bore of said displacer piston to form a clearance seal between the displacer piston inner bore and the displacer seal piston outer diameter and forming a gas spring with said clearance seal;

a linear drive motor for actuating linear reciprocating motion of said piston assembly;

a bearing spin motor for rotating said power piston;

a sliding joint between said displacer piston and said power piston for rotation of said displacer piston; and a thermodynamic assembly located remote from said expansion and compression spaces of said cryocooler and connected to said expansion and compression spaces by respective flexible tubes, said thermodynamic assembly including a cold head having a flat cold plate structure and a back surface formed by an expansion space heat exchanger and at least one regenerator, said cold plate located adjacent an expansion face of said at least one regenerator.

10. A Stirling free piston cryocooler according to claim 10, wherein the outer diameter of said power piston fits slidably within the inner bore of the power cylinder with close clearance and rotation of said power piston with the inner bore of said power cylinder and provides a power piston working gas hydrodynamic bearing and the close clearance provides a piston gas seal.

11. A Stirling free piston cryocooler according to claim 9, wherein the outer diameter of said displacer piston fits slidably within the inner bore of said displacer cylinder with close clearance and rotation of said displacer piston within the bore of said displacer cylinder and provides a displacer piston working gas hydrodynamic bearing and the close clearance provides a displacer piston gas seal.

12. A Stirling free piston cryocooler according to claim 9, wherein said flexible tube connection attenuates vibration from said piston assemblies.

13. A Stirling free piston cryocooler according to claim 9, wherein said power piston and said displacer bearings are rotated by said spin motor.

* * * * *